US012305409B2

(12) United States Patent
Yang

(10) Patent No.: US 12,305,409 B2
(45) Date of Patent: May 20, 2025

(54) DECK BUILDING FORMWORK CONVENIENT FOR SAFE AND EFFICIENT ASSEMBLY AND DISASSEMBLY

(71) Applicant: Qingdao Keva Formwork Scaffold Co., Ltd., Qingdao (CN)

(72) Inventor: Zhanhui Yang, Qingdao (CN)

(73) Assignee: Qingdao Keva Formwork Scaffold Co., Ltd., Qingdao (CN)

( * ) Notice: Subject to any disclaimer, the term of this patent is extended or adjusted under 35 U.S.C. 154(b) by 0 days.

(21) Appl. No.: 18/964,344

(22) Filed: Nov. 29, 2024

(65) Prior Publication Data

US 2025/0092694 A1 Mar. 20, 2025

Related U.S. Application Data

(63) Continuation of application No. PCT/CN2024/115513, filed on Aug. 29, 2024.

(30) Foreign Application Priority Data

Oct. 12, 2023 (CN) ..... 202311315363.X

(51) Int. Cl.
*E04G 11/48* (2006.01)

(52) U.S. Cl.
CPC ..... *E04G 11/486* (2013.01)

(58) Field of Classification Search
CPC ..... E04G 11/00; E04G 11/36; E04G 11/38; E04G 11/40
See application file for complete search history.

(56) References Cited

U.S. PATENT DOCUMENTS 2,599,670 A * 6/1952 Thomas ..... E04G 1/154 182/152
3,130,470 A * 4/1964 Bowden et al. ..... E04G 11/48 211/186

(Continued)

FOREIGN PATENT DOCUMENTS

CA 3065166 C * 9/2020 ..... E04G 11/38
EP 3121349 B1 * 6/2018 ..... E04G 11/36
GB 1067393 A * 5/1967 ..... E04G 11/38

OTHER PUBLICATIONS

CNIPA Application No. 201921149170.0, dated Jul. 19, 2019; English Machine translation generated Nov. 21, 2024 pp. 1-10.

(Continued)

*Primary Examiner* — Tara Mayo
(74) *Attorney, Agent, or Firm* — Addison D. Ault; IPGentleman Intellectual Property Services, LLC

(57) ABSTRACT

A deck building formwork capable of being assembled and disassembled is disclosed, comprising an aluminum profile frame and plywood segments nested therein. Corner parts are detachably fixed at the four corners of the aluminum profile frame, and cylindrical pins are provided for interlocking corner segments, wherein the bottom end of each cylindrical pin is in a spherical structure. Upright post components are further provided detachably fixed at the top end of steel support seats. The support seats are vertically sleeved in the middle of the upright post component in a sliding manner, wherein the top ends of four side walls of the support seats are provided with mounting grooves near the corners, and the spherical structure at the bottom end of the cylindrical pin is vertically engaged in the mounting groove.

10 Claims, 8 Drawing Sheets

(56) References Cited

U.S. PATENT DOCUMENTS 3,409,266 A * 11/1968 Jennings ..... E04G 17/04
248/165
3,533,592 A * 10/1970 Jennings ..... E04G 13/066
249/189
3,647,173 A * 3/1972 Pipala ..... E04G 11/486
249/31
3,807,681 A * 4/1974 Kane et al. ..... E04G 17/04
249/176
4,252,292 A * 2/1981 Armas ..... B28B 7/22
249/27
5,376,315 A * 12/1994 Fricke ..... E04H 9/14
264/275

OTHER PUBLICATIONS

CNIPA International Search Report for Application No. PCT/CN2024/115513; Sep. 26, 2024; machine translation generated Nov. 21, 2024, pp. 1-5.
CNIPA PCT International Search Report dated Sep. 26, 2024; machine translation generated Nov. 21, 2024, pp. 1-5.

* cited by examiner

DECK BUILDING FORMWORK CONVENIENT FOR SAFE AND EFFICIENT ASSEMBLY AND DISASSEMBLY

CROSS-REFERENCE TO RELATED APPLICATIONS

The present application claims priority to Chinese Patent Application No. CN 202311315363.X, filed on Oct. 12, 2023, the content of which is incorporated herein by reference in its entirety.

TECHNICAL FIELD

The present disclosure relates to the technical field of building formworks, in particular to a deck building formwork convenient for safe and efficient assembly and disassembly.

BACKGROUND

Building formwork is a kind of temporary supporting structure, which is made according to the design requirements, so that concrete structures and components can be shaped according to the specified position and geometric size, keep their correct positions, and bear the self-weight of building formwork and external loads acting on it. The purpose of formwork engineering is to ensure the quality and safety of concrete engineering, speed up the construction progress and reduce the engineering cost. In order to facilitate the pouring construction of the ceiling, the deck building formwork which can be quickly installed and disassembled is often used.

Traditionally, the widely used deck building formwork is generally supported by steel formwork and steel support. There are often problems such as being too heavy, cumbersome assembly and disassembly operations and short service life. Long-term use is prone to potential safety hazards. In addition, the existing early-dismounted formwork is difficult to be widely used, which is not conducive to the replacement and maintenance of parts, increases the use cost and restricts the construction speed.

SUMMARY

Aiming at solving the problems in the prior art that the deck building formwork is inconvenient to be assembled and disassembled safely and efficiently and the use cost is high, the present disclosure designs the deck building formwork which is convenient to be assembled and disassembled safely and efficiently.

In order to achieve the above object, the present disclosure provides the following technical solution: a deck building formwork convenient for safe and efficient assembly and disassembly includes a formwork and a steel support, wherein the formwork includes an aluminum profile frame and a plywood nested at a top of an inner cavity of the aluminum profile frame; corner parts are detachably fixed at four corners of the aluminum profile frame, a bottom of each of the corner parts is provided with a cylindrical pin extending vertically, and a bottom of the cylindrical pin has a spherical structure; a bottom end of an upright post component is detachably fixed on a top end of the steel support; a support seat is vertically sleeved in the middle of the upright post component in a sliding manner, mounting grooves are respectively provided at the positions of top ends of four side walls of the support seat near the corners, and the spherical structure at the bottom end of the cylindrical pin is vertically engaged at the mounting groove; and a locking block is movably sleeved at a lower part of the upright post component, and locks the support seat on the upright post component after moving relative to the upright post component in a horizontal direction.

Preferably, the four corners of the plywood are respectively provided with 45-degree chamfered edges, and the positions of the aluminum profile frame corresponding to the chamfered edges of the four corners of the plywood are respectively provided with gaps; the corner parts are detachably fixed at the gaps at the four corners of the aluminum profile frame, and the top ends of the corner parts are provided with vertical edges with inner side walls attached to the chamfered edges of the four corners of the plywood.

Preferably, the corner part further includes a middle corner plate, wing plates fixed at two sides of the middle corner plate and perpendicular to each other, a middle platform which is fixed at a top end of the middle corner plate and a top surface of which is attached to a bottom surface of the corner of the plywood, and a side platform which is fixed at top ends of the wing plates and a top surface of which is supported on the aluminum profile frame; the wing plate is provided with a plurality of connecting holes, and bolts sleeved in the connecting holes are configured for fixing the wing plates on the side walls of the aluminum profile frame; a bottom end of the vertical edge is vertically fixed at an edge of the middle platform, and a top end of the cylindrical pin is fixed at the middle of a bottom surface of the middle corner plate.

Preferably, two side walls of the middle corner plate are respectively provided with reserved holes.

Preferably, the upright post component includes a square vertical pipe, a connecting plate fixed at the bottom of the square vertical pipe and detachably and fixedly connected with the top of the steel support, and a top plate which is fixed at a top end of the square vertical pipe and a side edge of which is attached to an outer side wall of the vertical edge; the top plate is a square plate.

Preferably, the support seat includes a square support plate and side plates fixed at outer edges of a top surface of the support plate; the mounting grooves are provided at the top parts of the two ends of the side plate, and a middle part of the support plate is provided with a square hole which is matched and muff-coupled with the square vertical pipe in a sliding manner.

Preferably, an upper side and a lower side of the middle part of the square vertical pipe are respectively sheathed with an upper limit pin and a lower locking pin which are perpendicular to each other in the horizontal direction, and the support plate is provided with notches which are matched and engaged with the two ends of the lower locking pin vertically in a sliding manner; the locking block includes a block and a wedge-shaped locking strip, wherein one end of a middle part of the block is provided with an unlocking groove, and the other end of the middle part of the block is provided with a locking groove which is communicated with the unlocking groove; the wedge-shaped locking strips are provided on the two sides of the locking groove, and the locking groove is engaged and matched with the square vertical pipe in the horizontal direction in a sliding manner; a distance between front and rear walls of the unlocking groove is not less than a length of the lower locking pin; and a bottom surface of the wedge-shaped locking strip is provided with a slope.

Preferably, aluminum profile back ribs with top surfaces attached to the bottom surface of the plywood are fixedly connected between the side walls of the inner cavity of the aluminum profile frame, and aluminum reinforcing pipes are fixedly connected to the side walls of the inner cavity of the aluminum profile frame near the four corners.

Preferably, the middle parts of the side plates are respectively provided with weight-reducing grooves.

Preferably, attaching positions between the top of the side wall of the inner cavity of the aluminum profile frame and an inner side wall of the vertical edge and the plywood are filled with sealants respectively.

Compared with the prior art, the present disclosure has the following beneficial effects:

1. The deck building formwork which is convenient for safe and efficient assembly and disassembly adopts the formwork structure consisting of a plywood and an aluminum profile frames instead of the conventional steel formwork, which greatly reduces the weight of the formwork, reduces the labor intensity of workers and improves the safety of construction.
2. The corner part and the support seat in the deck building formwork which is convenient for safe and efficient assembly and disassembly are assembled through the spherical structure and the mounting groove, which is not only simple to assemble and easy to operate, but also convenient for the formwork structure to maintain a horizontal state.
3. The deck building formwork which is convenient for safe and efficient assembly and disassembly is convenient for assembling to form a large-area formwork structure; moreover, the parts are mostly detachable, which is convenient for the replacement of wearing parts, reducing the waste phenomenon and greatly reducing the construction cost.

REFERENCE SIGNS

Figure 1:
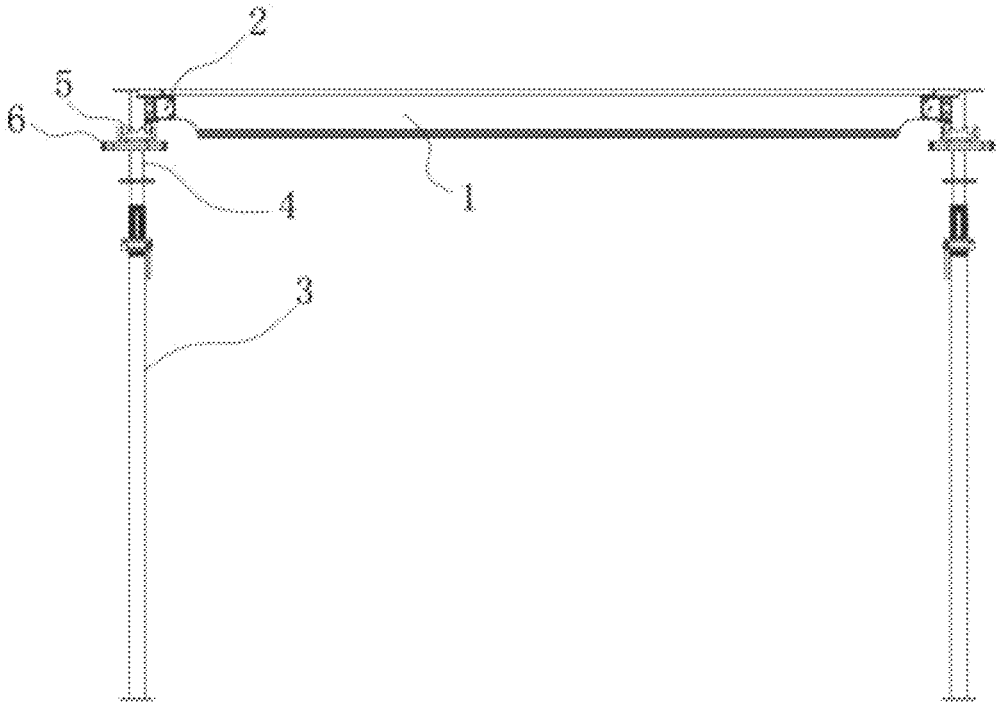
FIG. 1 is a schematic front view of the whole disclosure.
Figure 2:
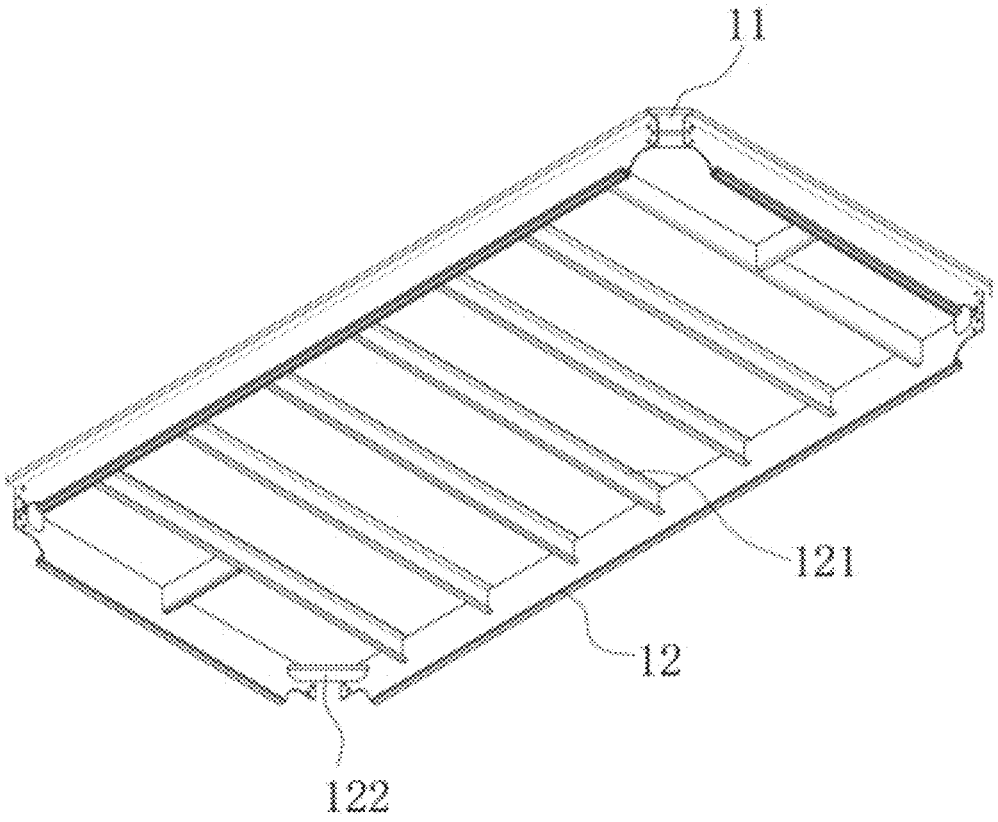
FIG. 2 is a schematic diagram of the three-dimensional structure of the formwork of the present disclosure.
Figure 3:
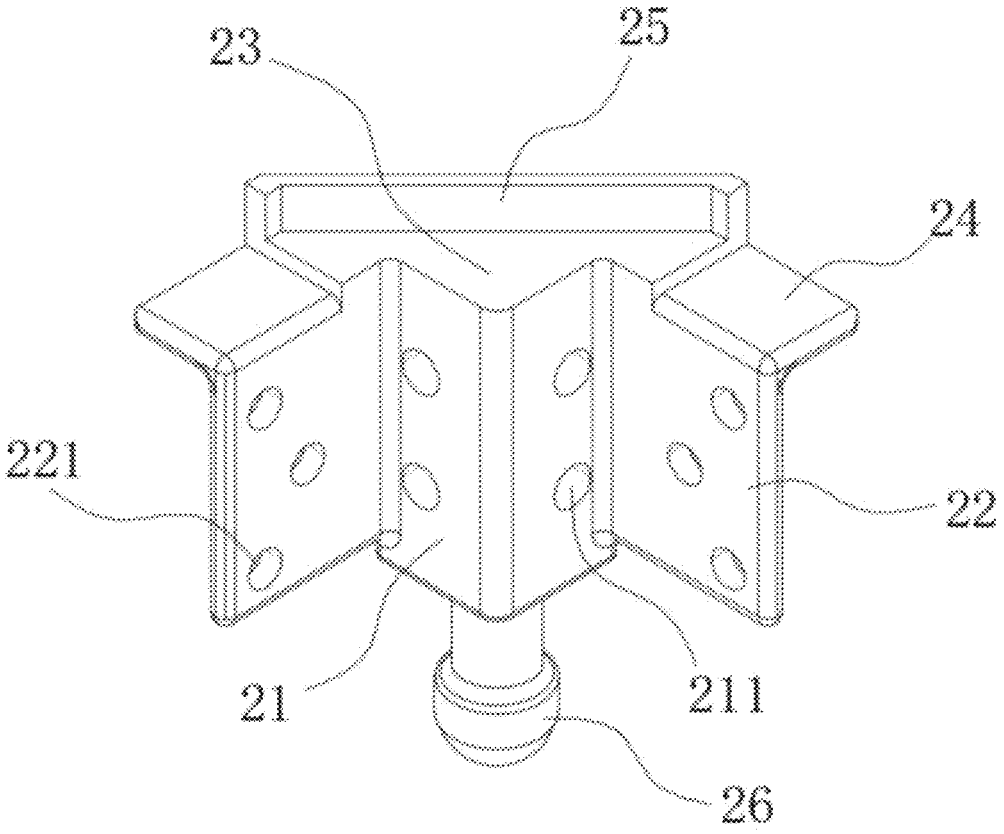
FIG. 3 is a schematic view of the three-dimensional structure of the corner part of the present disclosure.
Figure 4:
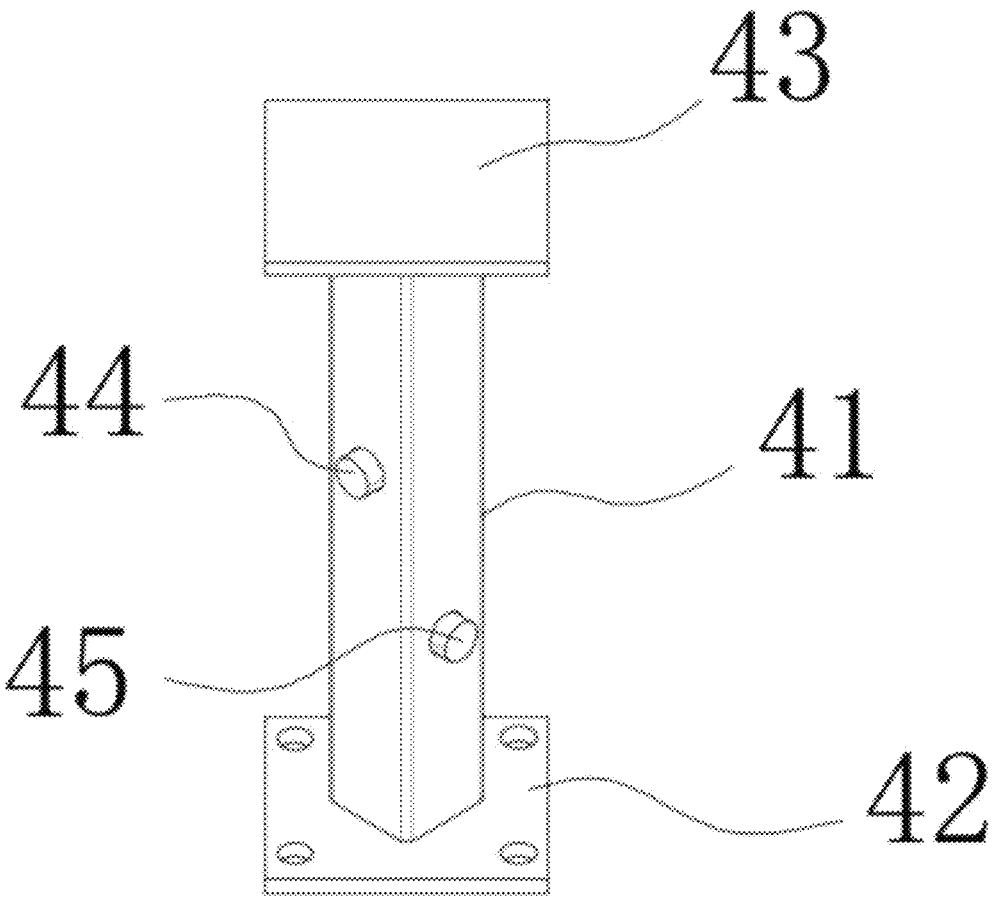
FIG. 4 is a schematic diagram of the three-dimensional structure of the upright post component of the present disclosure.
Figure 5:
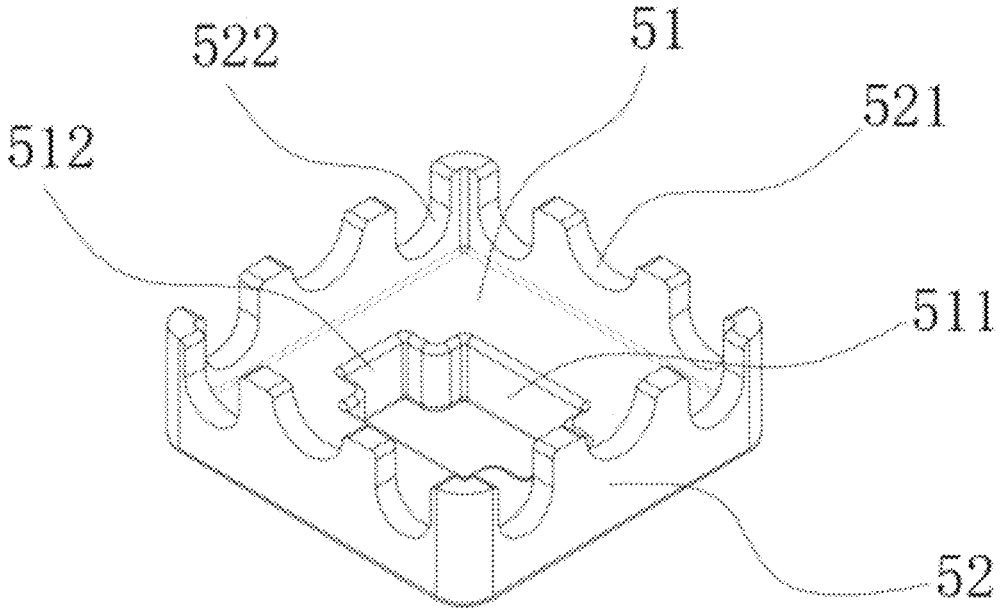
FIG. 5 is a schematic view of the three-dimensional structure of the support seat of the present disclosure.
Figure 6:
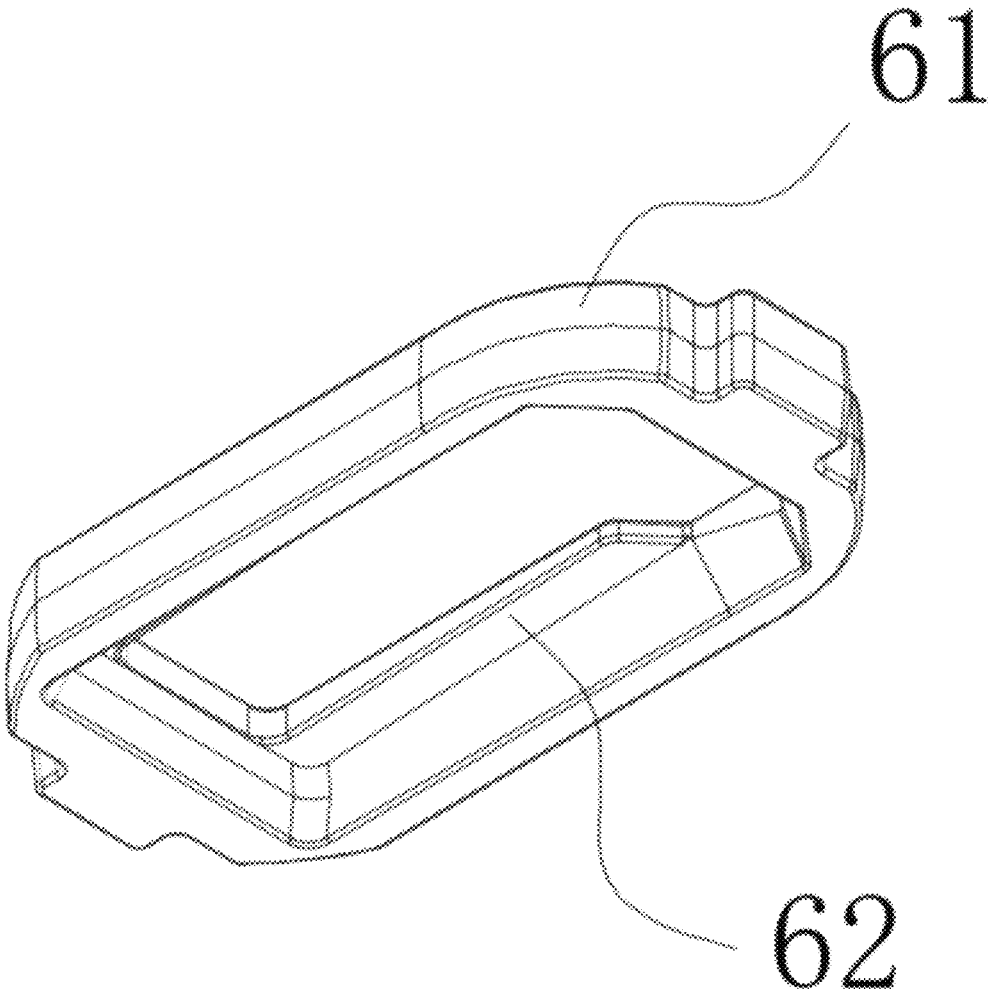
FIG. 6 is a schematic diagram of the three-dimensional structure of the locking block of the present disclosure.
Figure 7:
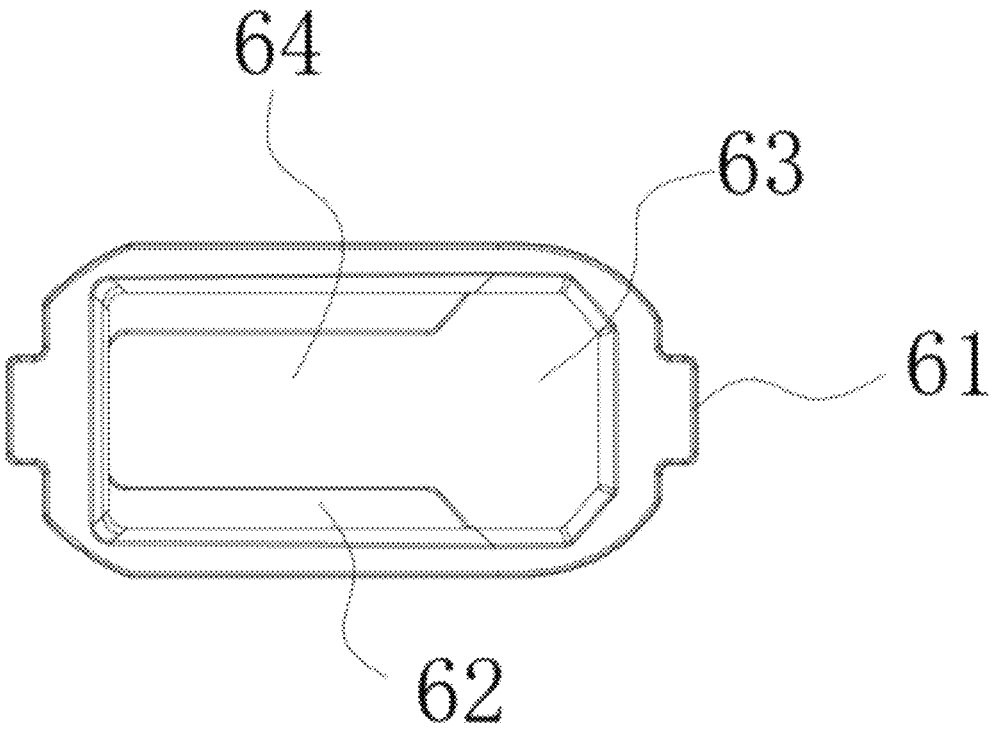
FIG. 7 is a schematic bottom view of the locking block of the present disclosure.

1—Formwork; 11—Plywood; 12—Aluminum profile frame; 121—Aluminum profile back rib; 122—Aluminum reinforcing pipe;

2—Corner part; 21—Middle corner plate; 211—Reserved hole; 22—Wing plate; 221—Connecting hole; 23—Middle platform; 24—Side platform; 25—Vertical edge; 26—Cylindrical pin; 3—Steel support;

4—Upright post component; 41—Square vertical pipe; 42—Connecting plate; 43—Top plate; 44—Upper limit pin; 45—Lower locking pin;

5—Support seat; 51—Support plate; 511—Square hole; 512—Notch; 52—Side plate; 521—Weight-reducing groove; 522—Mounting groove;

6—Locking block; 61—Block; 62—Wedge-shaped locking strip; 63—Unlocking groove; 64—Locking groove.

DESCRIPTION OF EMBODIMENTS

The technical solution in the embodiment of the present disclosure will be described clearly and completely with reference to the attached drawings. Obviously, the described embodiment is only part of, rather than all of the embodiment of the embodiments of the present disclosure. Based on the embodiment in the present disclosure, all other embodiments obtained by those skilled in the art without creative labor belong to the scope of protection of the present disclosure.

Referring to FIGS. 1-8, the present disclosure provides a technical solution, which is convenient for safe and efficient assembly and disassembly. The formwork 1 includes an aluminum profile frame 12 and a plywood 11 nested at the top of the inner cavity of the aluminum profile frame 12, wherein the plywood 11 is made of a wood material. An aluminum profile back rib 121 whose top surface is attached to the bottom surface of the plywood 11 is fixedly connected between the side walls of the inner cavity of the aluminum profile frame 12, and aluminum reinforcing pipes 122 are fixedly connected at positions of the inner cavity side walls of the aluminum profile frame 12 near the four corners, so that the whole formwork 1 not only has enough rigidity and strength, but also realizes light weight and greatly reduces the labor intensity of construction workers.

The four corners of the plywood 11 are respectively provided with 45-degree chamfered edges, and the positions of the aluminum profile frame 12 corresponding to the chamfered edges of the plywood 11 are respectively provided with gaps.

The corner parts 2 are detachably fixed at the four corners of the aluminum profile frame 12. The corner part 2 includes a middle corner plate 21, wing plates 22 fixed at two sides of the middle corner plate 21 and perpendicular to each other, a middle platform 23 which is fixed at a top end of the middle corner plate 21 and a top surface of which is attached to a bottom surface of the corner of the plywood 11, and a side platform 24 which is fixed at top ends of the wing plates 22 and a top surface of which is supported on the aluminum profile frame 12. The wing plate 22 is provided with a plurality of connecting holes 221, and bolts sleeved in the connecting holes 221 are configured for fixing the wing plates 22 on the side walls of the aluminum profile frame 12; a bottom end of the vertical edge 25 is vertically fixed at an edge of the middle platform 23, and the inner side walls of the vertical edge 25 are attached to the chamfered edge of the four corners of the plywood 11; the top end of a vertically extending cylindrical pin 26 is fixed to the middle of the bottom surface of the middle corner plate 21, and the bottom end of the cylindrical pin 26 has a spherical structure.

The middle corner plate 21, the wing plate 22, the middle platform 23, the side platform 24 and the vertical edge 25 are integrally formed, and the top end of the cylindrical pin 26 is welded to the bottom surface of the middle corner plate 21.

The vertical edge 25 and the aluminum profile frame 12 completely enclose the periphery of the plywood 11 to protect the periphery of the plywood 11 from impact and damage; in addition, the top of the side wall of the inner cavity of the aluminum profile frame 12 and the attaching positions between the top of the side wall of the inner cavity of the aluminum profile frame (12) and an inner side wall of the vertical edge (25) and the plywood (11) are filled with sealants respectively to protect the plywood 11 from moisture and prevent the plywood 11 from being cracked by blisters, thus greatly prolonging the service life of the plywood 11.

The upright post component 4 includes a square vertical tube 41, a connecting plate 42 fixed at the bottom of the square vertical pipe 41 and detachably and fixedly connected with the top of the steel support 3, and a top plate 43 which is fixed at a top end of the square vertical pipe 41 and a side edge of which is attached to an outer side wall of the vertical edge 25; the top plate 43 is a square plate. An upper limit pin 44 and a lower locking pin 45 perpendicular to each other are respectively sleeved on the upper side and the lower side of the middle part of the square vertical pipe 41 in the horizontal direction.

The support seat 5 comprises a square support plate 51 and side plates 52 fixed at outer edges of a top surface of the support plate 51; the mounting grooves 522 are provided at the top parts of the two ends of the side plate 52, and a middle part of the support plate 51 is provided with a square hole 511 which is matched and muff-coupled with the square vertical pipe 41 in a sliding manner. The support plate 51 is provided with notches 512 which are vertically engaged and matched with the two ends of the lower locking pin 45 in a sliding manner.

The locking block 6 includes a block 61 and wedge-shaped locking strips 62. One end of the middle part of the block 61 is provided with an unlocking groove 63, and the other end of the middle part of the block 61 is provided with a locking groove 64 communicating with the unlocking groove 63. The wedge-shaped locking strips 62 are provided on both sides of the locking groove 64, and the locking groove 64 is slidably engaged with the square vertical pipe 41 in the horizontal direction. The distance between the front and rear walls of the unlocking groove 63 is not less than the length of the lower locking pin 45. The bottom surface of the wedge-shaped locking strip 62 is provided with a slope.

To sum up, when assembling the whole deck building formwork, the square vertical pipe 41 is in the unlocking groove 63, and at the same time, the vertical pipe 41 moves the support seat 5 and the locking block 6 upward until the top surface of the support plate 51 abuts the bottom of the upper limit pin 44. At this time, the locking block 6 is knocked horizontally, so that the locking groove 64 gradually slides to the direction of the square vertical pipe 41, and at the same time, the bottom surface of the wedge-shaped locking strip 62 gradually slides along the top of the lower locking pin 45, until the wedge-shaped locking strip 62 is locked with the lower locking pin 45, and at this time, the support seat 5 is firmly locked on the square vertical pipe 41. Then, only the spherical structure at the bottom end of the cylindrical pin 26 need to be vertically engaged in the mounting groove 522, that is, the convex parts at both sides of the spherical structure are respectively engaged in the mounting groove 522 near the two sides of the corner of the support seat 5 during installation. Due to the self-weight of the whole formwork 1, the spherical structure will be firmly engaged into the mounting groove 522, thus realizing the installation of the formwork 1.

Figure 8:
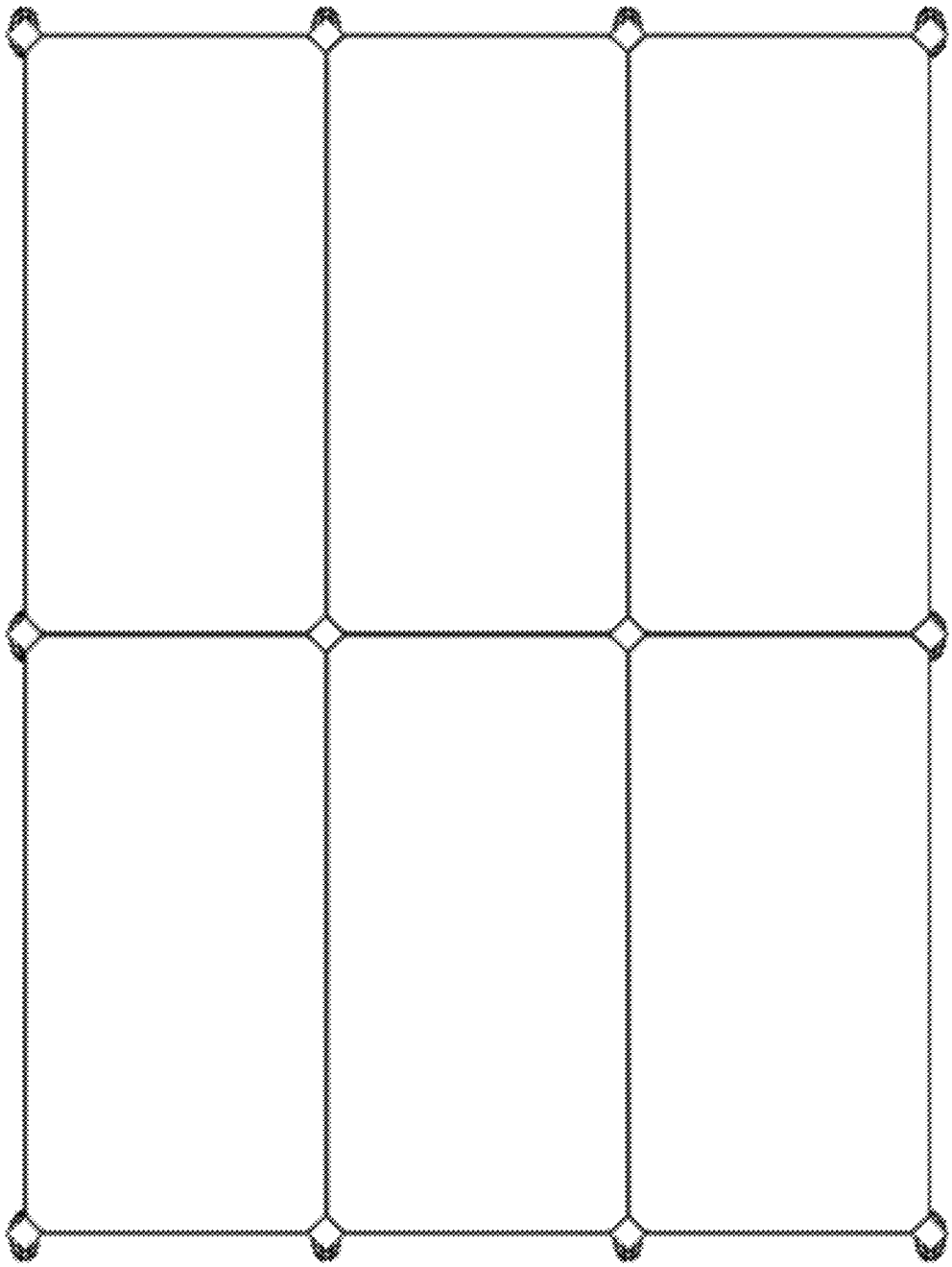
FIG. 8 is a schematic plan view of the assembled structure of deck building formwork of the present disclosure.

When assembling a plurality of formworks 1, the four sides of the top plate 43 are respectively attached to the outer side walls of the corresponding vertical edges 25, forming the structure as shown in FIG. 8, so that the panel structure formed by the formworks 2 is flat and stable.

When the formwork 1 is dismantled, the side of the locking block 6 is struck horizontally with a hammer to make it move in the horizontal direction. As the square vertical pipe 41 enters the unlocking groove 63 from the locking groove 64, the locking relationship between the wedge locking strip 62 and the lower locking pin 45 is released. At this time, due to the action of gravity, the support seat 5 and the locking block 6 will slide downward relative to the square vertical pipe 41, such that the spherical structure at the bottom end of the cylindrical pin 26 is disengaged from the mounting groove 522; in this way, the formwork 1 can be taken down until the cylindrical pins 26 corresponding to the four corners of the formwork 1 are separated from the mounting grooves 522 on the support seat 56.

In order to facilitate the connection of the inclined support structure, two side walls of the middle corner plate 21 are respectively provided with reserved holes 211.

In order to further reduce the overall weight of the deck formwork assembly, the middle parts of the side plates 52 are respectively provided with weight-reducing grooves 521.

It should be noted that in this paper, relational terms such as first and second are only used to distinguish one entity or operation from another entity or operation, and do not necessarily require or imply any such actual relationship or order between these entities or operations. Moreover, the terms "including", "comprising" or any other variation thereof are intended to cover non-exclusive inclusion, so that a process, method, article or equipment including a series of elements includes not only those elements, but also other elements not explicitly listed or elements inherent to such process, method, article or equipment.

Although embodiments of the present disclosure have been shown and described, it will be appreciated by those skilled in the art that various changes, modifications, substitutions and variations can be made to these embodiments without departing from the principles and spirit of the present disclosure, and the scope of the present disclosure is defined by the appended claims and equivalents thereof.

What is claimed is:

1. A deck building formwork capable of being assembled and disassembled, comprising a formwork and a steel support, wherein the formwork comprises an aluminum profile frame and a plywood nested at a top of an inner cavity of the aluminum profile frame;

the deck building formwork further comprises:

corner parts, which are detachably fixed at four corners of the aluminum profile frame, a bottom of each of the corner parts being provided with a cylindrical pin extending vertically, and a bottom of the cylindrical pin having a spherical structure;

an upright post component, a bottom end of which is detachably fixed on a top end of the steel support;

a support seat vertically sleeved in the middle of the upright post component in a sliding manner, mounting grooves being respectively provided at the positions of top ends of four side walls of the support seat near the corners, and the spherical structure at the bottom end of the cylindrical pin being vertically engaged at the mounting groove; and a locking block, which is movably sleeved at a lower part of the upright post component, and locks the support seat on the upright post component after moving relative to the upright post component in a horizontal direction.

2. The deck building formwork convenient for safe and efficient assembly and disassembly according to claim 1, wherein the four corners of the plywood are respectively provided with 45-degree chamfered edges, and the positions of the aluminum profile frame corresponding to the chamfered edges of the four corners of the plywood are respectively provided with gaps; the corner parts are detachably fixed at the gaps at the four corners of the aluminum profile frame, and the top ends of the corner parts are provided with vertical edges with inner side walls attached to the chamfered edges of the four corners of the plywood.

3. The deck building formwork convenient for safe and efficient assembly and disassembly according to claim 2, wherein the corner part further comprises a middle corner plate, wing plates fixed at two sides of the middle corner plate and perpendicular to each other, a middle platform which is fixed at a top end of the middle corner plate and a top surface of which is attached to a bottom surface of the corner of the plywood, and a side platform which is fixed at top ends of the wing plates and a top surface of which is supported on the aluminum profile frame; the wing plate is provided with a plurality of connecting holes, and bolts sleeved in the connecting holes are configured for fixing the wing plates on the side walls of the aluminum profile frame; a bottom end of the vertical edge is vertically fixed at an edge of the middle platform, and a top end of the cylindrical pin is fixed at the middle of a bottom surface of the middle corner plate.

4. The deck building formwork convenient for safe and efficient assembly and disassembly according to claim 3, wherein two side walls of the middle corner plate are respectively provided with reserved holes.

5. The deck building formwork convenient for safe and efficient assembly and disassembly according to claim 2, wherein the upright post component comprises a square vertical pipe, a connecting plate fixed at the bottom of the square vertical pipe and detachably and fixedly connected with the top of the steel support, and a top plate which is fixed at a top end of the square vertical pipe and a side edge of which is attached to an outer side wall of the vertical edge; the top plate is a square plate.

6. The deck building formwork convenient for safe and efficient assembly and disassembly according to claim 5, wherein the support seat comprises a square support plate and side plates fixed at outer edges of a top surface of the support plate; the mounting grooves are provided at the top parts of the two ends of the side plate, and a middle part of the support plate is provided with a square hole which is matched and muff-coupled with the square vertical pipe in a sliding manner.

7. The deck building formwork convenient for safe and efficient assembly and disassembly according to claim 6, wherein an upper side and a lower side of the middle part of the square vertical pipe are respectively sheathed with an upper limit pin and a lower locking pin which are perpendicular to each other in the horizontal direction, and the support plate is provided with notches which are matched and engaged with the two ends of the lower locking pin vertically in a sliding manner; the locking block comprises a block and a wedge-shaped locking strip, wherein one end of a middle part of the block is provided with an unlocking groove, and the other end of the middle part of the block is provided with a locking groove which is communicated with the unlocking groove; the wedge-shaped locking strips are provided on the two sides of the locking groove, and the locking groove is engaged and matched with the square vertical pipe in the horizontal direction in a sliding manner; a distance between front and rear walls of the unlocking groove is not less than a length of the lower locking pin; and a bottom surface of the wedge-shaped locking strip is provided with a slope.

8. The deck building formwork convenient for safe and efficient assembly and disassembly according to claim 6, wherein the middle parts of the side plates are respectively provided with weight-reducing grooves.

9. The deck building formwork convenient for safe and efficient assembly and disassembly according to claim 2, wherein attaching positions between the top of the side wall of the inner cavity of the aluminum profile frame and an inner side wall of the vertical edge and the plywood are filled with sealants respectively.

10. The deck building formwork convenient for safe and efficient assembly and disassembly according to claim 1, wherein aluminum profile back ribs with top surfaces attached to the bottom surface of the plywood are fixedly connected between the side walls of the inner cavity of the aluminum profile frame, and aluminum reinforcing pipes are fixedly connected to the side walls of the inner cavity of the aluminum profile frame near the four corners.

* * * * *